US005759349A

United States Patent [19]

Foster et al.

[11] Patent Number: 5,759,349

[45] Date of Patent: Jun. 2, 1998

[54] LUMEN LOADING OF HYGIENIC END USE PAPER FIBERS

[75] Inventors: James Joseph Foster; Roger Wayne Ogden, both of Covington, Va.

[73] Assignee: Westvaco Corporation, New York, N.Y.

[21] Appl. No.: 899,697

[22] Filed: Jul. 25, 1997

Related U.S. Application Data

[63] Continuation of Ser. No. 572,689, Dec. 14, 1995, abandoned.

[51] Int. Cl.[6] ..... D21H 21/30

[52] U.S. Cl. ..... 162/158; 162/9; 162/162; 162/182; 162/183

[58] Field of Search ..... 162/162, 181.2, 162/9.183, 182, 158

[56] References Cited

U.S. PATENT DOCUMENTS

| | | | |
|---|---|---|---|
| 4,510,020 | 4/1985 | Green et al. | 162/181.2 |
| 5,026,507 | 6/1991 | Gowan, Jr. et al. | 252/301.21 |
| 5,043,370 | 8/1991 | Gowan, Jr. | 524/35 |
| 5,096,539 | 3/1992 | Allan | 162/181.2 |
| 5,141,672 | 8/1992 | Gowan, Jr. | 252/301.21 |
| 5,223,090 | 6/1993 | Klungness et al. | 162/181.2 |
| 5,275,699 | 1/1994 | Allan et al. | 162/181.2 |

OTHER PUBLICATIONS

Sandoz Chemicals Corp., "Fluorescent Whitening Agents", 1997, brochure.

H. V. Green, T. J. Fox & A. M. Scallan, "Lumen-loaded paper pulp," Pulp & Paper Canada, 83 (7), T203–T207 (1982).

A. M. Scallan & S. R. Middleton, "The Preparation of Lumen-Loaded Pulp," in Papermaking Raw Materials, 1985 ed. V. Punton, Mechanical Engineering Publications Ltd., London, vol. 2, 613–630.

M. L. Miller & D. C. Paliwal, "The Effects of Lumen-Loading on Strength and Optical Properties of Paper," J. of Pulp and Paper Science vol. 11, No. 3, May '85, J84–J88.

S. R. Middleton & A. M. Scallan, Lumen-Loading Bleached Pulps, 1989 Annual Meeting, A1–A8.

S. R. Middleton & A. M. Scallan, "Lumen Loading of Bleached Pulps," J. of Pulp and Paper Science: vol. 15 No. 6, Nov. 1989, J229–J235.

G. G. Allan, A. R. Negri & P. Ritzenthaler, "The micro-porosity of pulp . . . " Tappi Journal, Mar. 1992, 239–244.

S. R. Middleton & A. M. Scallan, "Partial lumen loading," Nordic Pulp and Paper Research J. No. 1/1993, 204–207, 231.

J. Petlicki & T. G. M. van de Ven, "Adsorption of polyethylenimine onto cellulose fibers," Colloids and Surfaces, 83, (1994) 9–23.

J. Petlicki & T. G. M. van de Ven, "Kinetics of Lumen Loading," J of Pulp and Paper Science, vol. 20 No. 12, 1994, J375–J382.

*Primary Examiner*—Peter Chin

*Attorney, Agent, or Firm*—J. R. McDaniel; R. L. Schmalz

[57] ABSTRACT

This invention relates to the application of an optically active dye or fluorecent whitening agent within a paper fiber such that the dye or whitening agent does not migrate out of the fiber at a level of toxicological concern. Such processes of this type, generally, allow the dye or whitening agent to be used in hygienic end use applications.

14 Claims, No Drawings

LUMEN LOADING OF HYGIENIC END USE PAPER FIBERS this application is a continuation of application Ser. No. 08/572,689 filed Dec. 14,1995, now abandoned.

BACKGROUND OF THE INVENTION

1. Field of the Invention

This invention relates to the application of a chemical compound within a paper fiber such that the compound does not migrate out of the fiber at a level of toxicological concern. Such processes of this type, generally, allow the compounds to be used in hygienic end use applications.

2. Description of the Related Art

The requirements for producing a hygienic end use paper/paperboard are considerable. Requirements have to be rigorous to protect the public from inadvertent harm from the materials used in the manufacture of the package. The public can be potentially harmed by deleterious compounds migrating from the packaging into the product.

Hygienic packaging requirements can be divided into two sections. The first stipulates that only approved compounds can be used to manufacture hygienic packaging. The second requires an extraction test to be performed on the final product. The extraction test determines the extent of the compound migrating out of the packaging. An example of the requirements can be seen in the United States Code of Federal Regulations 21 § 176.170. Similar requirements are being developed by the European Common Market.

There are situations where it would be desirable to use compounds that are either not approved or used in a concentration in excess of the approved level. An example of this type of compound is Fluorescent Whitening Agents (FWAs or Optical Brighteners). These compounds are cost effective in increasing the perceived brightness (or whiteness) of the paper/paperboard. These compounds are used extensively in printing and writing papers where hygienicity is not a primary concern.

The purpose of the present invention is to develop a process whereby these compounds can be used in hygienic end use applications without toxicological concerns. While originally conceived for hygienic end uses, this technique is not limited to these applications. In fact, this process can also be used in non-hygienic applications where it is desirable to place organic materials inside a hollow fiber.

With this background in mind, we will now discuss various areas related to lumen loading.

Fluorescent Whitening Agents (FWAs)

Fluorescent Whitening Agents (or Optical Brighteners) are compounds that effect the perceived brightness of an object. One example is "bluing" used in laundering operations. Bluing absorbs energy in the ultraviolet region of the light spectrum and emits the energy in the visible region. The effect of using this compound when laundering is to make clothes or fabrics appear brighter and whiter.

In a similar fashion, FWAs are used in the paper industry to make paper appear brighter (or whiter). Unfortunately, these brightening materials are typically stilbene derivatives that are suspected carcinogens. Therefore, these materials are not allowed for use in food packaging. However, they are employed extensively in printing and writing grades of paper and paperboard where the hygienicity is not a factor in its end use.

Opacity and Lumen Loading

For many papers, opacity is an essential property. Opacity is the complement of transparency and it is more important when thin papers are printed on both sides. For example, papers with low opacity allow the typeface from the backside to show through. Opacity is typically obtained by adding "fillers" which are fine particles of an insoluble solid, usually of a mineral origin. Unfortunately, by adding filler to the sheet, one can decrease the mechanical strength of the paper. Fillers can interfere with the fiber/fiber bonding. Additionally, the fiber/filler bond is usually not as strong as the fiber/fiber bond.

One method to retain strength properties while using high levels of filler is by "lumen loading."Lumens are the hollow cores of the cellulose paper fiber. Under the correct process conditions, one can force or precipitate filler materials into the lumen. After loading the lumen with filler, the filler external to the fiber is washed way and the fiber is ready to be formed into a sheet. By placing the filler inside the fiber, the fiber/fiber bonds are not decreased, thereby improving the strength properties.

The use of lumen loading is well known. In particular, U.S. Pat. No. 5,096,539 ('539), entitled "Cell Wall Loading of Never-Dried Pulp Fibers" to G. Allan, U.S. Pat. No. 5,223,090 ('090) to J. Klungness, entitled "Method for Fiber Loading a Chemical Compound", and U.S. Pat. No. 5,275,699 ('699) to G. Allan et al., entitled "Compositions and Methods for Filling Dried Cellulosic Fibers with an Inorganic Filler " are exemplary of such prior art. Generally, these references teach a co-precipitation of filler within the fibers which is accomplished by impregnating the fiber with a suitable salt, draining the fibers, then treating with calcium chloride. The calcium and the salt react to form calcium carbonate which precipitates out of solution. Essentially, these processes precipitate the filler on and in the fibers. In short, these references are concerned with applying increased levels of inorganic filler within paper fibers with little or no adverse affect on the strength of the final paper product.

In contrast, the present invention is not concerned with applying fillers or with strength properties of the fiber. Instead, the present invention deals with applying the chemical compound within the fiber such that the compound does not migrate out of the fiber at a level of toxicological concern.

Also, it should be noted that the references refer to the inorganic filler and/or a particulate material. The process of "lumen loading" of an organic or a non-filler material is not referred to by any of these references.

Once the lumen (core) of a fiber is loaded with the compound, it may be desirable to retain as much of that material within the lumen (not readily extractable) as possible. It has been determined that "once-drying" of the loaded virgin fiber reduced extraction of the loaded lumen by as much as 75%. "Once-drying" physically collapses the fiber and "closes" the lumen. Drying also closes lumen pores (or ports) and renders the loaded material less accessible to extraction. Low intensity mechanical refining of cellulosic fibers increases the potential for lumen collapse. In these studies, a virgin fiber with a large, easily collapsible lumen (pine) was chosen.

It was also determined that the practice of "sizing" further reduces extractable levels. Sizing inhibits penetration of liquids into the internal structure of the paper. For example, if the liquid penetrant is water, sizing converts the polar, hydrophilic fiber surface to a non-polar, hydrophobic surface by covering or modifying that surface, in a controlled manner, with a water resistant (water repellant) material. Sizing with rosin (sodium rosinate) and papermaker's alum (aluminum sulfate) deposits hydrophobic aluminum rosinate onto the fiber surface, thus increasing the water repellency of the treated surface.

Many other sizing techniques are common to the industry. Some of the practices increase repellency of non-polar liquids (oils, inks, etc.). Some practices are enhanced (even triggered) by temperature during paper drying. Some are surface treatments applied after paperforming while others mix components with the papermaking fibers prior to forming. Some other commonly employed sizing techniques include, but are not limited to:

1. Free Rosin/Hydroxy Ammonium Salts,
2. Dispersed/Modified/Emulsified Rosin Size,
3. AKD (Alkyl Ketene Dimer) Size,
4. ASA (Alkenyl Succinic Acid) Size,
5. Fluorochemicals, and
6. Silanes and Silicones.

Sizing further reduced ethanol (EtOH) extractable levels of loaded, once-dried fiber by almost 80% (determined spectrophotometrically). The particular FWA used was not water soluble and water extraction quantities were not easily measured. Water extractable levels were lower than EtOH extractable levels. The lowest EtOH extractables were obtained by sizing with 1% rosin and 2% alum (pH 4.1). Neither the increased concentration of size/alum (up to 10% rosin and 20% alum) nor lumen loading of size/alum significantly further reduced the EtOH extractable levels. Thus, lumen loading of size should further reduce water extractables.

It is apparent from the above that there exists a need in the art for a process which is able to lumen load, and which at least equals the lumen loading capability of the known processes, but which at the same time is capable of being used for hygienic end use papers. It is a purpose of this invention to fulfill these and other needs in the art in a manner more apparent to the skilled artisan once given the following disclosure.

SUMMARY OF THE INVENTION

Generally speaking, this invention fulfills these needs by providing a method of lumen loading papermaking fibers for hygienic end uses, comprising dissolving an optically active agent in a first solution, mixing the agent and the solution with hygienic end use paper fibers having substantially uncollapsed lumens to cause the optically active agent to substantially enter into the lumens of the fibers, substantially removing any excess agent and first solution from an outside of the lumens, and, sealing, if necessary, the fibers to substantially prevent any of the agent from migrating from the lumens.

In certain preferred embodiments, the first solution is a suitable solvent. Also, the agent and the first solution are thoroughly and vigorously mixed. The excess agent and the first solution are then removed by a second solution, e.g. a suitable solvent. Also, the lumen are sealed by several different processes such as sizing and/or once-drying. Finally, the optically active agent could be optically active dyes or fluorescent whitening agents.

In another further preferred embodiment, this method of lumen loading employs compounds that can be used in the hygienic end use applications without toxicological concerns.

The preferred method, according to this invention, offers the following advantages: ease of lumen loading; good stability; good economy; reduced compound migration; reduced toxicological concerns; and increased hygienic end uses. In fact, in many of the preferred embodiments, these factors of ease of loading, reduced compound migration, reduced toxicological concerns and increased hygienic end uses are optimized to an extent that is considerably higher than heretofore achieved in prior, known lumen loading methods.

The above and other features of the present invention, which will become more apparent as the description proceeds, are best understood by considering the following detailed description.

DETAILED DESCRIPTION OF THE INVENTION

In this section we will refer to fiber lumen loading with FWAs sizing materials. Please note that FWA is used for illustrative purposes only. Other s oluble o rganic compounds such as other optically active agents such as dyes can be used in the process, as can alternate hollow fibers (i.e., tubular nylon, etc.). Based upon teachings in the present invention, one skilled in the art can apply this process to a variety of systems.

The process consists of two major steps:

1) FWA loading of the fiber lumen; and

2) Sealing the fiber s o that FWA is retained.

These are described briefly below.

First, the FWA is dissolved in a suitable solvent. The FWA/solvent mixture is then directly mixed with paper fibers. After the fiber/FWA solution is combined, the entire solution is vigorously mixed for a period of time causing the dissolved FWA to migrate into the lumen. Under these conditions, the FWA is said to be lumen loaded into the fiber. After the FWA/fiber solution has been sufficiently mixed, the fiber is drained to remove the excess FWA solution. The fiber is then washed to remove a portion, if not all, of the FWA external to the fibers. Finally, the sealing of the fiber is not strictly necessary for the present invention and conceivably some FWA/solvent/fiber blends would adequately bind/deposit the FWA onto the fibers without sealing. However, the fiber sealing process can be performed by several different chemical processes. For example, the standard practice within the paper industry to use alum/rosin to "size", the fiber. Also, "once-drying" can be used to seal the fiber surfaces. Additionally, other optically active compounds could be used. For example, these optically active agents could be fluorescent agents which glow in a different color under ultraviolet (UV) radiation.

The specific structure of the preferred method of lumen loading of the hygienic end use papermaking fibers will be discussed with reference to the following example, however it is to be understood that one skilled in the art could apply the present invention to other applications.

EXAMPLE

As discussed earlier the process consists of two major steps, namely, FWA loading of the fiber lumen and the sealing of the fiber so that the FWA is retained. These are described in more detail below.

First, the FWA is dissolved in a suitable solvent. In the current embodiment of the prevent invention, the solvent is methanol but another suitable solvent can be chosen by anyone skilled in the art. The amount of FWA dissolved in the solvent can vary according to the application.

The FWA/solvent mixture can be directly mixed with paper fibers. However, one can use water with certain solvents to increase the safety of the operation. Safety is improved because the solvent/water mixture is not as flammable as the pure solvent. Examples of solvents that are miscible with water include ethanol, methanol and many other alcohols. It should be noted that the FWA may dissolve in water thereby making this safety point nonapplicable.

After the fiber/FWA solution is combined, the entire solution is vigorously mixed for a period of time causing the dissolved FWA to migrate into the lumen. Under these conditions, the FWA is said to be "lumen loaded" into the fiber. This vigorous mixing can be accomplished by use of a conventional "disintegrator". A disintegrator is standard pulp laboratory or pulping equipment and is commonly used to uniformly disperse the papermaking fibers within the solution with the minimum amount of fiber cutting/damage. It is believed that the vigorous stirring causes two phenomena to be accomplished, namely, it ensures that the FWA and fibers are well mixed (there are no concentration gradients within the system) and it causes some fiber flexing which pumps fluid in and out of the fiber lumen, thereby, distributing the FWA inside.

The period of time for vigorous mixing can be varied, with typical times being 15 minutes to several hours. In the present invention, 30 minutes gives satisfactory results, however, it is expected that the optimal time will vary with fiber predominate species and the degree of bleaching (if bleached at all), and the drying history of the fiber.

After the FWA/fiber composition has been sufficiently mixed, the fiber is drained to remove the excess FWA solution. The fiber is then washed to remove a portion, if not all, of the FWA external to the fibers. This is accomplished by more gentle mixing than a disintegrator and by using a suitable solvent. The suitable solvent could be water, the same solvent used to dissolve the FWA or a completely different solvent. One skilled in the art would be able to make this determination with the information contained in the present invention. Please note that some FWAs may be retained on the outside of the fiber. While this is unavoidable, it is not overly detrimental to the process.

After the FWA has been loaded into the fiber, the fiber may be sealed. The sealing of the fiber is not strictly necessary for the present invention and conceivably some FWA/solvent/fiber blends would adequately bind/deposit the FWA onto the fibers without sealing. However, there are certain advantages to sealing the fiber. Primarily, it serves to more tightly hold the FWA within and on the fiber, thereby, minimizing migration from the hygienic end use paper.

The fiber sealing process can be performed by several different chemical processes. For example, it is standard practice within the paper industry to use alum/rosin to "size" the fiber. In this manner, sizing refers to the process of treating the fiber to make the surface hydrophobic (water resistant). This alum/rosin size can be used to seal the fiber. Alternate sizing agents include those listed previously. One skilled in the art can use these agents or their equivalents to seal the fiber.

"Once-drying" may also seal the cellulose fiber surface. Pores into the lumen are closed and the lumens often collapse. Rehydration of these collapsed, dried fibers is difficult.

Once these operations are performed and the fiber is properly sealed, the fiber is ready for the papermaking process. The lumen loaded/sealed fibers can be used directly in the process or can be dried for use at a later time. Drying collapses the fiber and closes some lumen pores "or ports" which further minimizes FWA loss from the interior.

Rosin/alum sizing, surface and lumen loading, further reduces FWA extractable levels. Note that the current embodiment of the present invention lumen loads FWA into the paper fiber. However, there is nothing to preclude lumen loading of other soluble, nonparticulate compounds. Examples of these compounds include, but are not limited to, chlorine scavengers such as sulfites and oxygen scavengers such as cobalt compounds. Furthermore, the process of the present invention may be applicable to other fiber systems, such as hollow nylon or carbon fibers.

The above example mainly uses Van der Waals and/or hydrogen bonding to attach the organic compound on to the fiber. One can also use chemical bonding to attach these organic compounds to the fiber. Indeed, there are certain circumstances where chemically bonding the additives is preferred.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. A method of lumen loading paperboard fibers for hygienic end uses, wherein said method is consisting essentially of the steps of:

dissolving a soluble optically active dye in a solvent;

mixing said dye and said solvent with hygienic end use paper fibers having substantially uncollapsed lumens to cause said dye to substantially enter into said lumens of said fibers;

substantially removing any excess dye and said solvent from an outside of said lumens; and sealing, if necessary, said fibers to substantially prevent any of said dye from migrating from said lumens.

2. The method, as in claim 1, wherein said solvent is further comprised of:

methanol.

3. The method, as in claim 1, wherein mixing step is further comprised of the step of:

mixing said agent and said solvent in a disintegrator.

4. The method, as in claim 1, wherein said agent and solvent removal step is further comprised of the steps of:

draining said fibers; and washing said fibers with said solvent.

5. The method, as in claim 1, wherein said solvent is further comprised of:

water.

6. The method, as in claim 1, wherein said sealing step is further comprised of the step of:

sizing said fibers with sodium resinate and aluminum sulfate.

7. The method, as in claim 1, wherein said sealing step is further comprised of the step of:

once-drying.

8. A method of lumen loading paperboard fibers for hygienic end uses, wherein said method is consisting essentially of the steps of:

dissolving a soluble optically active fluorescent whitening agent in a solvent;

mixing said agent and said solvent with hygienic end use paper fibers having substantially uncollapsed lumens to cause said agent to substantially enter into said lumens of said fibers;

substantially removing any excess agent and said solvent from an outside of said lumens; and sealing, if necessary, said fibers to substantially prevent any of said agent from migrating from said lumens.

9. The method, as in claim 8, wherein said solvent is further comprised of:

methanol.

10. The method, as in claim 8, wherein mixing step is further comprised of the step of:

mixing said agent and said solvent in a disintegrator.

11. The method, as in claim 8, wherein agent and solvent removal step is further comprised of the steps of:

draining said fibers; and washing said fibers with said solvent.

12. The method, as in claim 8, wherein said solvent is further comprised of:

water.

13. The method, as in claim 8, wherein said sealing step is further comprised of the step of:

sizing said fibers with sodium resinate and aluminum sulfate.

14. The method, as in claim 8, wherein said sealing step is further comprised of the step of:

once-drying.

* * * * *